US007537876B2

(12) United States Patent
Anno et al.

(10) Patent No.: US 7,537,876 B2
(45) Date of Patent: May 26, 2009

(54) ELECTROSTATIC CHARGE IMAGE DEVELOPING TONER

(75) Inventors: Masahiro Anno, Hachioji (JP); Mikihiko Sukeno, Hino (JP); Takanori Tanaka, Hirakata (JP)

(73) Assignee: Konica Minolta Business Technologies, Inc. (JP)

( * ) Notice: Subject to any disclaimer, the term of this patent is extended or adjusted under 35 U.S.C. 154(b) by 469 days.

(21) Appl. No.: 11/320,870

(22) Filed: Dec. 28, 2005

(65) Prior Publication Data

US 2006/0204878 A1 Sep. 14, 2006

(30) Foreign Application Priority Data

Mar. 8, 2005 (JP) ..... 2005-063473

(51) Int. Cl.
*G03G 9/08* (2006.01)

(52) U.S. Cl. ..... 430/108.6; 430/108.7; 430/109.1; 430/109.3

(58) Field of Classification Search ..... 430/108.6, 430/108.7, 109.1, 109.3
See application file for complete search history.

(56) References Cited

U.S. PATENT DOCUMENTS 7,208,252 B2 4/2007 Grande et al.
2003/0050190 A1* 3/2003 Mochizuki et al. ..... 503/208
2003/0059700 A1* 3/2003 Konya et al. ..... 430/108.6
2003/0148203 A1* 8/2003 Suzuki et al. ..... 430/110.3
2003/0165761 A1 9/2003 Arai et al.
2005/0147908 A1* 7/2005 Yamane et al. ..... 430/108.3
2007/0125269 A1* 6/2007 Nishi ..... 106/481

FOREIGN PATENT DOCUMENTS

JP 06-208241 7/1994
JP 08-044103 2/1996
JP 09071417 * 3/1997
JP 2004-138644 5/2004

OTHER PUBLICATIONS

Abstract of JP 09071417.*
Machine English language translation of JP 09071417.*

* cited by examiner

*Primary Examiner*—Hoa V Le
(74) *Attorney, Agent, or Firm*—Squire, Sanders & Dempsey L.L.P.

(57) ABSTRACT

Disclosed is an electrostatic charge image developing toner containing external additives possessing at least amorphous silica and a crystallized metal oxide selected from titanium oxide, aluminum oxide, zirconium oxide, or calcium oxide, wherein the amorphous silica is placed as a nucleus, and the crystallized metal oxide is present on the silica surface.

7 Claims, 1 Drawing Sheet

ELECTROSTATIC CHARGE IMAGE DEVELOPING TONER

TECHNICAL FIELD

The present invention relates to an electrostatic charge image developing toner.

BACKGROUND

A compact type printer of the electrophotographic method operating at low cost, accompanied with improved image performance via high resolution, has recently been desired. On the one hand, a toner having a small particle diameter has been utilized due to customer demand for the foregoing image quality.

In order to realize a compact printer at low cost, structure members of a developing apparatus and the apparatus configuration itself are to be simplified, or the number of parts are considered to be reduced. As a result, by an amount equivalent to the simplification of an apparatus, it was particularly difficult to adjust and control temperature and humidity, and process correction. Similarly to a toner transport system and a toner supply system, a toner itself was also desired to be improved in order to transport a toner smoothly. When a, toner having a small particle diameter is used for an apparatus, and the toner remains unused for a couple of days with no operation of the apparatus, the interparticle density is increased, whereby the fluidity tends to be markedly lowered, which is also called "packing".

A technique to counter the above problem is to provide external additives, for which acicular titanium and titanium-enclosing silica are used as a method of improving toner transportability (refer to Patent Document 1, for example). It is also reported that a toner into which such external additives are added exhibits excellent image transfer and image improvement (refer to Patent Document 2, for example).

Printers designed for office use require speedy print preparation to meet the demand of an office environment. Accordingly, though the speedy charge rising capability of a toner is recently desired in order to satisfy the above demand, a toner capable of high-speed print preparation has not been acquired. In the foregoing document, for example, the improved charge rising capability via adding the external additives was disclosed, but the speedy print preparation was not addressed. Thus, it was difficult to improve the charge rising capability of a toner employing existing external additives.

Toner of a small particle diameter which results in the foregoing "packing" tends to decrease the amount of charge during no operation of the apparatus for a long period of time, whereby it is further difficult to realize the speedy print preparation. Since variation in tonal resolution are easily generated through the unstable toner supply during printing, caused by lowered toner fluidity as a result of "packing", it was difficult to accurately read contents in graphs containing prints and recognize photographic images in which data variance is frequently shown by a gradual change of density.

In order to follow up the charge rising capability, a method of using a charge supporting member is proposed (refer to Patent Document 3), but this method is not appropriate for a low cost compact printer since an increased number of parts as well as a complicated apparatus configuration are introduced.

(Patent Document 1) Japanese Patent O.P.I. Publication No. 6-208241.

(Patent Document 2) Japanese Patent O.P.I. Publication No. 8-44103

(Patent Document 3) Japanese Patent O.P.I. Publication No. 2004-138644

SUMMARY

It is an object of the present invention to provide an electrostatic charge image developing toner capable of exhibiting a charge rising capability which is capable of speedy print preparation.

Still, it is also an object of the present invention to provide a toner capable of generating an excellent charge rising capability and sufficient fluidity with no occurrence of "packing", even though the apparatus has not been operated for a long period of time.

Still, it is an object of the present invention to provide an electrostatic charge image developing toner capable of forming stable images with no variation in tonal resolution for a low cost compact printer which is designed with a reduced number of parts and a simple structure of the overall apparatus.

An aspect of the invention can be an electrostatic charge image developing toner containing external additives comprising at least amorphous silica and a crystallized metal oxide selected from titanium oxide, aluminum oxide, zirconium oxide, or calcium oxide, wherein the amorphous silica is placed as a nucleus, and the crystallized metal oxide is present on the nucleus surface.

BRIEF DESCRIPTION OF THE DRAWINGS

Embodiments will now be described, by way of example only, with reference to the accompanying drawings which are meant to be exemplary, not limiting, and wherein like elements numbered alike in several figures, in which.

DETAILED DESCRIPTION OF THE INVENTION

Figure 1:
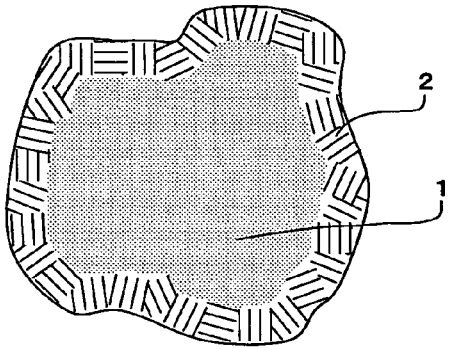
FIG. 1 is a schematic cross-sectional view showing an example of external additives of the present invention.

A toner of the present invention contains external additives made of amorphous silica and a crystallized metal oxide selected from titanium oxide, aluminum oxide, zirconium oxide, or calcium oxide (hereinafter, referred simply to as external additives), and the external additives are of a structure in which the amorphous silica is placed as a nucleus, and the crystallized metal oxide is present on the nucleus surface.

It is found that a toner containing external additives with the above structure can inhibit lowering of the amount of charge at high-temperature and humidity such as 30° C. and 80% RH, or at low-temperature and humidity such as 10° C. and 20% RH. Though the reason why such an effect occurs in a toner containing the above external additives is not clear, it is presumed to be caused by an electrical property of the above external additives. It is presumably considered, that is to say, that the crystallized metal oxide exhibiting a semiconducting property and the amorphous silica exhibiting an insulating property appropriately interact in the ambient environment, resulting in the foregoing effect.

When the amount of charge exceeds a certain level, charges move from the external additive surface to the nucleus at low-temperature and humidity, under which an excessive amount of charge tends to remain on the external additive surface, whereby the charge density basically remains constant. Thus, charge leakage caused by humidity or moisture on the crystallized metal oxide surface occurs at high-temperature and humidity, and this charge is then supplied to the external additive surface, whereby the charge density on the surface basically remains constant.

Toner fluidity is presumably considered to be improved, since a metal oxide is present on the external additive surface. As a result, even though toner "packing" is caused by no operation of an image forming apparatus for a long period of time, toner transportability may not be degraded since toner fluidity is improved. Since developing torque necessary for toner transport is also lowered due to improved toner fluidity, wasteful electrical power consumption is reduced, so that no burden is presumably applied to the toner transporting and driving members.

It is also assumed that the releasing of external additives from a toner, caused by toner-to-toner contact or collision rarely occurs, since the burden is reduced in the case of the improved toner fluidity even though toner-to-toner contact occurs during transporting of the toner. As a result, toner cleaning property is improved, so that an excellent cleaning performance is expected with existing cleaning apparatus.

An electric dipole is formed on the toner surface by using a resin containing an ionic dissociative group such as a resin derived from acrylic acid, methacrylic acid, or the like, as a binder resin constituting a base material of toner, whereby external additives adhere firmly to the toner surface. As a result, since external additives are retained on the toner surface with no penetration of external additives into the toner interior or with no releasing of external additives from the toner surface, toner charging property is controlled in a balanced manner, whereby toner charging performance is maintained with no influence from the ambient environment.

External additives of the present invention will now be further detailed.

<<External Additive>>

An external additive of the present invention contains amorphous silica and a metal oxide, the metal oxide is present on the amorphous silica surface, and further the metal oxide is crystallized, and constitutes a part or full of the external additive surface.

<Number Average Primary Particle Diameter of External Additive>

The number average primary particle diameter of external additives is preferably 35-500 nm, and more preferably 40-300 nm in view of stabilizing the charge on the toner surface, and to stably retain external additives on the toner base material surface.

In addition, the number average primary particle diameter can be measured employing a high resolution transmission electron microscope (HR-TEM). The horizontal Feret diameter of 100 random external additives was measured to calculate the arithmetic average. The particle selection is conducted by selecting external additives adhered to outline portions of toner particles.

(Structure of External Additive)

An external additive of the present invention is of a structure in which a metal oxide is present on the surface of amorphous silica, which is placed as a nucleus.

Examples of specific metal oxide include titanium oxide, aluminum oxide, zirconium oxide, and calcium oxide, of which titanium oxide is preferable, and titanium dioxide is specifically preferable. Titanium dioxide is preferably in the form of crystallized titanium dioxide, and the rutile type structure is specifically preferred.

When external additive particles are observed employing a transmission electron microscope (TEM), amorphous silica as a nucleus and a metal oxide on the surface are determined via TEM observation.

FIG. 1 is a schematic cross-sectional view showing an example of external additives of the present invention.

In FIG. 1, numeral 1 designates the region where amorphous silica is present, and numeral 2 designates the region where a crystallized metal oxide is present.

As shown in the figure, a crystallized metal oxide is present on the amorphous silica surface in the external additive.

External additives of the present invention are preferably treated with a commonly known hydrophobic agent such as a silane coupling agent or silicone oil. A hexamethyldisilane compound is specifically preferable as a hydrophobic agent.

A confirmation method of the external additive structure will now be explained here.

(Confirming Crystallization of Metal Oxide on the Surface)

Herein, the external additive surface means the outline portion observed by a transmission electron microscope (TEM).

External additives are sampled on a grid mesh on which a micro-grid is provided, and transmission images are observed employing a transmission electron microscope (TEM), preferably a high resolution transmission electron microscope (HR-TEM) such as a field emission type transmission electron microscope (FE-TEM).

In the case of a metal oxide in external additives, which contains a crystalline structure, an electron beam passing through a specimen is split into two waves of a transmitted wave and a diffracted wave.

Lattice images corresponding to crystallinity of the specimen can be observed by observing interference images obtained via a transmitted wave and a diffracted wave. Since a phase-contrast, by which an interference image is formed, is proportional to the diffraction width, whereby a detectable contrast can be obtained even in the case of a small amount of scattering, such as in the case of a single atom, high resolution observation of lattice images is sufficiently possible. Incidentally, regarding the observation method for the lattice image, S. Horiuchi "Koubunkainou Denshi Kenbikyou (a high resolution electron microscope)" Kyouritsu Shuppan, 1988, can be referred to.

(Confirmation of Amorphous State of silica Serving as Nucleus)

The amorphous silica region is observed to be rather more whitish than the metal oxide region, and the compositions can commonly be examined via a fluorescent X-ray analyzer supplied with a TEM.

In the case of the external additives used in the present invention, lattice images were observed in the metal oxide region which is present on the particle surface employing the above FE-TEM (accelerating voltage: 200 kV). Since lattice images were not observed in the center region of a particle, though lattice images were observed on the surface of the particle, the presence of amorphous silica was confirmed in combination with the data of fluorescent X-ray analysis.

<Measuring Method>

It is preferable that a toner containing external additives is sampled on a grid mesh on which a micro grid of carbon is provided and the transmission image is observed by a transmission electron microscope (TEM), but preferably a high resolution transmission electron microscope (HR-TEM) such as a field emission type transmission electron microscope (FE-TEM). The structure and the composition of the external additive can be determined by focusing on the external additive at the toner outline portion.

<Measuring Conditions>

A dispersion liquid, produced by dispersing the toner in pure water falls in drops onto a grid mesh on which a micro grid is provided, and is then dried to prepare an observation specimen.

The structure and the composition are evaluated by a 200 kV field emission type transmission electron microscope JEM-2010F manufactured by Nihon Denshi Co., Ltd. and an energy dispersive X-ray analyzer (EDS) Voager manufactured by Thermo Norman Co., Ltd.

Conditions are set to be as follows:

Acceleration voltage: 200 kV

Observation magnitude of TEM image: 50,000

Measuring time of EDS (Live time): 50 seconds

Measuring energy range: 0-2,000 eV

The specific surface area of the external additive is preferably 2-100 $m^2/g$ in BET value. This BET value is measured by a nitrogen gas absorption method, and specifically measured by a BET one point method with FLOWSORB 2300 manufactured by Shimadzu Corporation.

<Presence Ratio of Metal Oxide on the Surface>

Though a metal oxide is present on the amorphous silica surface or constitutes the external additive surface, the metal oxide does not necessarily cover the amorphous silica completely.

When the presence ratio of metal oxide on the surface is measured by electron spectroscopy for chemical analysis (ESCA), content of metal atoms is 30-99% by number with respect to the total number of silicon atoms and metal atoms is preferable, and more preferable is 55-96%. Specifically, in the case of the composition of silica and titanium dioxide, a structure in which the detected content of titanium dioxide is 30-99% by weight is preferable.

The content ratio of the metal atom present on the external additive surface can be measured employing an X-ray photoelectron spectroscopic analyzer "ESCA-1000" (manufactured by Shimadzu Seisakusho Co.), the quantitative analysis of each element is conducted under analytical conditions mentioned below and the content ratio of the silicon atom is calculated employing the peak area of each atom.

Content ratio of silicon atom (Si amount)=(Peak-area of Si atom)/(Sum of peak areas of Si and metal elements)

(Analytical Conditions)

X-ray: Mg anode type

Acceleration: 10 kV, 30 mA

Resolving power: 31.5 eV

Measurement element: silicon and metal elements

<Preparation of External Additive>

It is preferable that external additives of the present invention are prepared by a vapor phase process.

One method of decorating the surface of particle (A) with powder (B) by introducing particle (A) and powder (B) into high temperature flame is provided as a preparation method of external additives via a vapor phase process. In the present invention, particle (A) is amorphous silica, and powder (B) is a crystallized metal oxide.

It is preferable that the particle diameter of particle (A) is greater than that of powder (B), and powder (B) is adhesively fused around particle (A).

It is preferable that powder (B) adheres to particle (A) surface via heat-fusion to such an extent that the original form of powder (B) on the particle (A) surface can not be observed. In this case, the particle (A) surface is reformed with powder (B) by placing coexisting particle (A) and powder (B) in a flame.

It is preferable in consideration of stable preparation that particle (A) precedes powder (B) from the aspect of timing of placement in the flame, and powder (B) is subsequently placed into flame, after crystals have grown.

Plural particles are commonly associated in high temperature flame, whereby larger diameter particles are formed. Though particle (A) and powder (B) coexist in the same high temperature range, the heat-receiving area of powder (B) becomes greater than that of particle (A). Further, it is considered powder (B) is heat-fused more easily than particle (A) when powder (B) is smaller in size than particle (A). Accordingly, since association and growth of particle (A) are inhibited by controlling the burning amount of flammable gas, for example, conditions under which powder (B) is adhesively fused onto particle (A) can be easily determined.

When powder (B) is associated and collided with particle (A), and powder (B) is adhesively fused onto particle (A), it is clear that external additives of the present invention are acquired. In the case of heat-fusion of particle(A)-to-particle (A), probability of collision with particle (A) and of binding to particle (A) prior to sufficient growth is high. This is because a small diameter particle is considered to move more easily in an air stream than a large diameter particle. Even in the case of particles obtained via association and collision of associated and grown powder (B) and particle (A) in a way such as above, external additives of the present invention can be acquired if a given composition ratio is satisfied.

In this process, it is seen that powder (B) is placed on the surface of particle (A) when powder (B) subjected to flame treatment adheres to the surface of particle (A). External additives of various particle diameters, specific surface areas; and composition ratios can be prepared, depending on flame treatment conditions.

Crystallized titanium oxide particles, crystallized aluminum oxide-particles, crystallized zirconium oxide particles, or an admixture of their crystallized compound particles may be used as powder (B).

Figure 2:
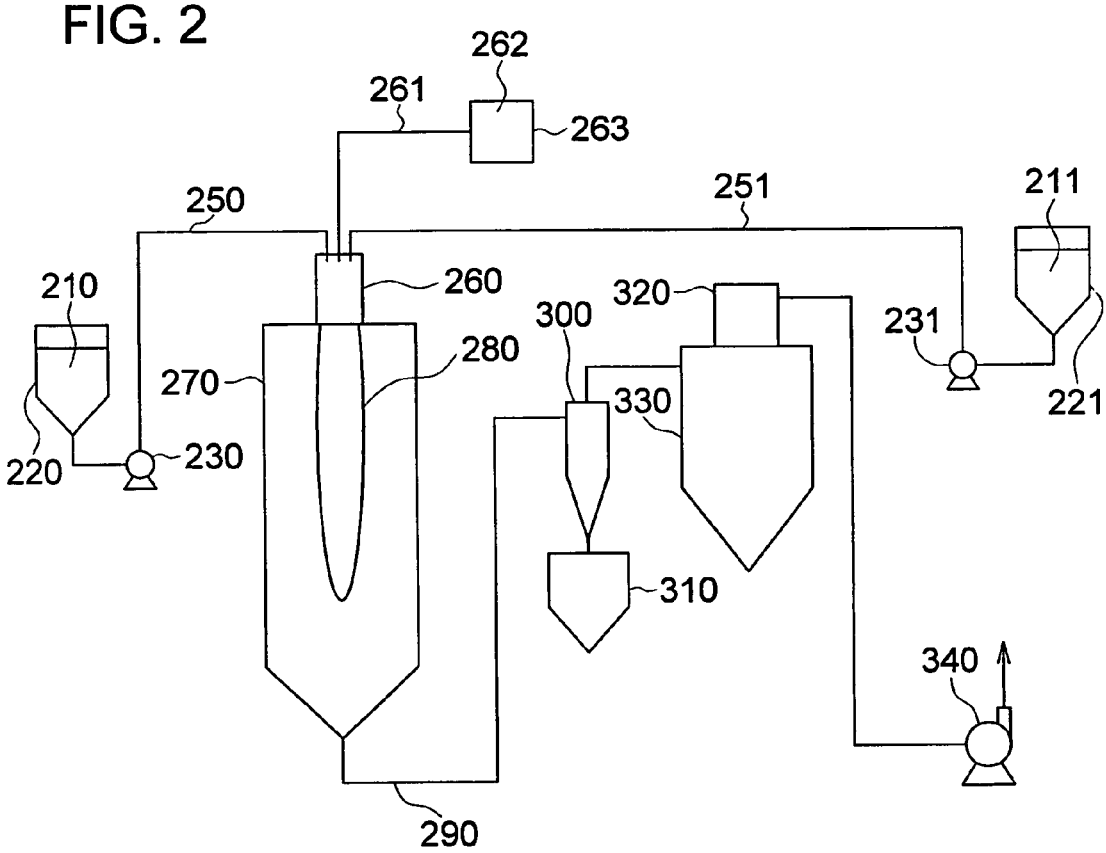
FIG. 2 is a schematic diagram showing an example of the production equipment of preparing external additives of the present invention.

The preferable amorphous silica used as particle (A) can be obtained via combustion of silicon halide or organic silicon compound in a burning flame of propane gas or methane gas, employing the production equipment as shown in FIG. 2.

A crystallized metal oxide used as powder (B) can be obtained via combustion of a metal oxide raw material in a flame of hydrocarbon gas such as propane gas or methane gas, employing production equipment as shown in FIG. 2. The preferable examples of the above crystallized metal oxide include crystallized titanium oxide, crystallized aluminum oxide, crystallized zirconium oxide, and an admixture of their crystallized compounds. A preparation method with inter-powder composite treatment is described, but the method is not limited thereto. Also provided is another method of delaying the spraying timing of the raw material gas.

Used singly or in arbitrary combination can be titanium sulfate or titanium tetrachloride as a titanium source; zirconium oxide, zirconium oxychloride, zirconium tetrachloride, zirconium sulfate, or zirconium nitrate as a zirconium source; aluminum chloride, aluminum sulfate, or sodium aluminate as an aluminum source; and calcium carbonate or calcium sulfate as a calcium source; which are provided as raw materials of metal oxide.

FIG. 2 is a schematic diagram showing an example of the production equipment of preparing external additives of the present invention.

This apparatus is preferably used for preparing external additives via oxidation in a flame by exposing the external additive raw material to the burner as a vapor or a powder.

In FIG. 2, numeral 210 designates particle (A), numeral 220 designates a tank for particle (A), numeral 230 designates a fixed quantity supply pump, numeral 250 designates an introducing pipe of particle (A), numeral 211 designates powder (B), numeral 221 designates a tank for powder (B), numeral 231 designates a metering supply pump for powder (B), numeral 251 designates an introducing pipe of powder (B), numeral 261 designates an introducing pipe for a mixed gas of oxygen and water vapor, numeral 262 designates a mixed gas of oxygen and water vapor, numeral 263 designates a tank for the mixed gas of oxygen and water vapor, numeral 260 designates a main burner, numeral 270 designates a combustion furnace (reaction pipe), numeral 280 designates the combustion flame, numeral 290 designates a smoke way, numeral 300 designates a cyclone, numeral 320 designates a bag filter, numerals 310 and 330 designate recovering containers, and numeral 340 designates an exhausting fan.

As shown in FIG. 2, particle (A) 210 and powder (B) 211 are introduced into main burner 260, having a spray nozzle installed at the very top, via a raw material introducing pipe from the tank for particle (A) and powder (B) by a metering supply pump. Particle (A) and powder (B), together with mixed gas 262 of oxygen and water vapor are sprayed into the interior of combustion furnace 270, and ignited by a subsidiary flame to form combustion flame 280. The external additives formed via combustion is cooled together with the exhaust gas in smoke way 29 and separated by cyclone 300 and bag filter 320, and then caught by recovering containers 310 and 330. The exhaust gas was evacuated by exhausting fan 340.

In addition, the raw material is prepared by mixing particle (A) and powder (B) in advance, and this mixed raw material together with a mixed gas of oxygen and water vapor may be sprayed into the interior of the combustion furnace.

<<Toner Base Material>>

In the present invention, the toner before external additives are added, is called the toner base material.

The toner base material is preferably formed employing a binder resin containing an ionic dissociative group in its structure. Specifically, styrene-acryl copolymer or polyester resin is preferably used.

A so-called chemical toner, prepared in an aqueous medium, is preferably used as the toner base material. When this toner base material is combined with the above resulting external additives, excellent images can be stably achieved, since characteristics and advantages exhibited by both of them complement one another.

Formation of a chemical toner is not limited to a single method, but an emulsion association method of forming the chemical toner is specifically preferred. Further, the binder resin is preferably a polymerizable monomer containing an ionic dissociative group which can be obtained by copolymerizing acrylic acid or methacrylic acid of 1-10% by weight.

<<Addition of External Additives to Toner Base Material>>

In the present invention, the amount of external additives added to a toner base material is preferably 0.1-2 W by weight, based on the toner base material.

Various commonly known mixers such as a tabular mixer, a HENSCHEL MIXER, a tauner mixer and a V-type mixer can be employed as the apparatus for mixing external additives with the toner base material.

It is desirable that external additives of the present invention described in Structure 1 are utilized, but an admixture of commonly known external additives may also be used.

Inorganic fine particles used as commonly known external additives can be provided. Specifically, fine silica particles, fine titanium particles, and fine alumina particles are preferably used. These fine inorganic particles are preferably hydrophobic.

Spherical organic particles of a number average primary particle diameter of approximately 10-2,000 nm can be provided as the fine organic particles which are used as the external additive. Polystyrene, polymethyl methacrylate, or a co-polymer of styrene-methyl methacrylate is provided as the fine organic particle constituent material.

It is preferable that the toner satisfies at least one of the following structures:

1) elapsed time before a maximal charging amount is acquired is less than 3.5 seconds, and a charging amount equivalent to the lowered value after 120 minutes is less than 10 μC/g;
2) fog density in the frequent toner replacement mode that is specified to be the density at non-image portion of two hundredth paper sheet, after continuously printing 200 paper sheets, is not more than 0.01;
3) tonal resolution is not less than 40 tonal resolution levels for both prints at the initial stage and at the stage after standing for 120 hours at high-temperature and humidity of 30° C. and 80% RH.

<<Developer>>

The toner can be employed as a single-component developer and a double-component developer.

When the toner is used as the single-component developer, the toner is usually employed in a form of a non-magnetic single component developer or a magnetic single component developer in which the toner contains a magnetic particle having a diameter of approximately 0.1-0.5 μm, but both developers can be used.

When the toner is employed as the double-component developer by mixing with a carrier composed of magnetic particles, known metals such as iron, ferrite and magnetite and alloys of the metals with another metal such as aluminum and lead are employable. Of these, the ferrite particle is particularly preferred. The particle diameter of the above carrier is preferably 20-100 μm in median particle diameter ($D_{50}$), and more preferably 25-80 μm.

The particle diameter of the carrier can be measured with a laser diffraction type particle size distribution measuring apparatus "HELOS" (manufactured by Sympatec Co., Ltd.), equipped with a wet type dispersing device.

A carrier in which the magnetic particle is coated with a resin and a resin dispersed type carrier in which the magnetic particle is dispersed in a resin can preferably be used. Olefin type resins, styrene type resins, styrene-acryl type resins, silicone resins, ester type resins and fluorine-containing polymer resins are employed as the coating resin, though the resin is not specifically limited. Commonly known resins can be employed for constituting the resin dispersed type carrier without any limitation. For example, styrene-acryl resins, polyester type resins, fluorinated type resins and phenol type resins are usable. Of these, the coat carrier which is coated by styrene-acryl resin is more preferable, since protection of the releasing and durability of external additives can be obtained.

<<Image Forming Apparatus>>

A toner of the present invention is preferably used for an image forming apparatus utilizing a developing apparatus for a magnetic single component developer, a non-magnetic single component developer, or a double-component developer. Of these, the image forming apparatus utilizing a developing apparatus for a non-magnetic single component developer is more preferable.

A diameter of a developing roller used in the developing apparatus is preferably 5-40 mmϕ, and more preferably 7-15 mmϕ. Since a toner of the present invention is possible to be applied to a developing roller having a small diameters of 5-10 mmϕ, the whole image forming apparatus can be compactly designed.

EXAMPLE

Next, the present invention will be explained employing examples, but the present invention is not limited thereto. Incidentally, "part" in the description represents "part by weight".

<<Manufacture of External Additive>>

<Manufacture of External Additive 1>

(Manufacture of Particle (B1))

The manufacturing apparatus described in FIG. 2 was used for preparing particle (B1) as a raw material of external additive 1.

Gaseous titanium tetrachloride of 100% by volume in concentration and a mixed gas containing oxygen of 96 W by volume and water vapor of 4% by volume were separately preheated at 1,000° C., and introduced into a reaction pipe (combustion furnace) at flow velocity of 45 m/s and at flow velocity of 50 m/s, respectively, employing a coaxial parallel nozzle. The titanium tetrachloride gas was introduced into an inner pipe. The reaction temperature was set to 1,300° C. Cooling air was also introduced into the reaction pipe in such a way that high temperature retention time consumed in the reaction pipe was not more than 0.011 seconds, and titanium dioxide particles manufactured by using a bag filter made of polytetrafluoroethelene were subsequently collected.

The number average primary particle diameter of the resulting titanium dioxide particles was 20 nm, and it was confirmed via transmission electron microscopy observation that plural crystals aggregated, and were sintered. This titanium dioxide was designated as particle (B1).

(Manufacture of Powder (A1))

The manufacturing apparatus described in FIG. 2 was used for preparing powder (A1) as a raw material of external additive 1.

Oxygen gas was supplied to a burner after opening a combustion holding gas supply pipe to ignite the ignition burner, and hydrogen gas was subsequently supplied to a burner to form flame after opening a flammable holding gas supply pipe. Silicon tetrachloride gasified by an evaporator was supplied to this, and a flame hydrolysis reaction was conducted under conditions described below to collect silica powder by a bag filter as a recovery apparatus. The number average primary particle diameter of the resulting silica particles was 190 nm. This silica particle was designated as particle (A1).

Conditions: 200 kg/hr of an amount of gas flow of silicon tetrachloride, 60 $Nm^3$/hr (hydrogen gas), 60 $Nm^3$/hr (oxygen gas), and 0.012 seconds in retention time. Particle (B1) and powder (A1) were subjected to composite treatment, employing the manufacturing apparatus described in FIG. 2.

The raw material was mixed in a resin bag in such a way that proportion of the forgoing particle (B1) to the foregoing powder (A1) was arranged to be 2 to 8 by weight in advance, and introduced into tank 210. The admixture accompanied with air as a carrier gas was subsequently transported via introducing pipe 250 at a supply velocity of 4 kg/hr, and sprayed from a nozzle. The nozzle-spraying flow velocity of air was 48 m/s at this time.

Incidentally, the inner diameter of the reaction pipe was 100 mm, and the reaction temperature was 1,300° C.

Cooling air was also introduced into the reaction pipe in such a way that high temperature retention time consumed in the reaction pipe was not more than 0.3 seconds, and powder manufactured by using a bag filter made of. polytetrafluoroethelene was subsequently collected. The collected powder was heated under air atmosphere in an oven at 500° C. for one hour, and was subjected to dechlorination treatment. This fine particle of 500 parts by weight was heated, was set in a high speed stirring mixer equipped with a cooling jacket, and while stirring at 500 rpm, pure water of 25 parts by weight was hermetically sprayed and supplied. Subsequently, this stirring was continuously conducted for 10 minutes. After this, hexamethyldisilazane of 25 parts by weight was added into what was produced, and the stirring was hermetically conducted for 60 minutes. Subsequently, a heat treatment process was also conducted while stirring, and produced ammonia gas and the residual treatment agent were eliminated while ventilating with nitrogen at 150° C. This is designated as external additive 1.

The number average primary particle diameter of the resulting external additive 1 was 220 nm, and it was confirmed via transmission electron microscopy observation that plural crystals of titanium dioxide on the surface of amorphous silica nucleus were sintered. In addition, titanium dioxide crystals were determined to be a rutile type via X-ray diffraction.

<Manufacture of External Additive 2>

(Manufacture of Particle (B2))

Gaseous aluminum chloride diluted with nitrogen by 26% in concentration and a mixed gas containing oxygen of 35% by volume and water vapor of 65% by volume were separately preheated at 1,100° C., and introduced into a reaction pipe at flow velocity of 61 m/s and at flow velocity of 55 m/s, respectively, employing a coaxial parallel nozzle. The aluminum chloride gas was introduced into an inner pipe. Cooling air was also introduced into the reaction pipe in such a way that high temperature retention time comsumed in the reaction pipe was not more than 0.05 seconds, and aluminum oxide particles manufactured by using a bag filter made of polytetrafluoroethelene were subsequently collected.

The number average primary particle diameter of the resulting aluminum oxide particles was 18 nm, and it was confirmed via transmission electron microscopy observation that plural crystals of γ-type aluminum oxide aggregated and were sintered. This aluminum oxide was designated as particle (B2).

(Composite Treatment of Particle (B2) and Powder (A1))

Similarly to the foregoing external additive 1, particle (B2) and powder (A1) were subjected to composite treatment to acquire external additive 2.

The number average primary particle diameter of the resulting external additive 2 was 220 nm, and it was confirmed via transmission electron microscopy observation that plural crystals of aluminum oxide on the surface of amorphous silica nucleus were sintered.

<Manufacture of External Additive 3>

(Manufacture of Particle (B3))

Zirconium tetrachloride and a mixed gas containing oxygen of-35% by volume and water vapor of 65% by volume in a heated solid evaporator were separately preheated at 530° C., and introduced into a reaction pipe at flow velocity of 61 m/s and at flow velocity of 55 m/s, respectively, employing a coaxial parallel nozzle. Cooling air was also introduced into the reaction pipe in such a way that high temperature retention time consumed in the reaction pipe was not more than 0.011 seconds, and zirconium oxide particles manufactured by using a bag filter made of polytetrafluoroethelene were subsequently collected.

The number average primary particle diameter of the resulting zirconium oxide was 19 nm. This zirconium oxide was designated as particle (B3).

(Composite Treatment of Particle (B3) and Powder (A1))

Similarly to the foregoing external additive 1, particle (B3) and powder (A1) were subjected to composite treatment to acquire external additive 3.

The number average primary particle diameter of the resulting external additive 3 was 220 nm, and it was confirmed via transmission electron microscopy observation that plural crystals of zirconium oxide on the surface of amorphous silica nucleus were sintered.

<Comparative External Additive 1>

Silica sol was first added into a sodium carbonate solution of 3,160 g/L, and subsequently, a titanyl sulfate solution obtained by dissolving metatitanic acid with hot concentrated sulfuric acid which was subjected to deironization treatment fell in drops on the sodium carbonate solution so as not to exceed 25° C. in solution temperature. When pH reached 10, the process of dropping titanyl sulfate stopped, and the precipitation was formed.

After this precipitation was sufficiently filtrated and washed until the sulfate radical disappeared, hydrochloride acid was added, and titanium oxide and hydrochloric acid were adjusted to be 30 g/L and 15 g/L in concentration, respectively. This solution was heated, and a ripening process was conducted at 85° C. for 30 minutes to prepare titaniasol covering silica. After neutralizing up to pH 5.5 with sodium hydroxide, followed by filtration and washing processes, titanium oxide particles covering silica were acquired.

Water slurry includes the resulting titanium oxide particles covering silica, pH was adjusted to be 2.0 by adding hydrochloric acid of 6 mol/L, and n-butyltrimethoxysilane of 25 W by weight, based on titanium oxide (25 parts by weight of n-butyltrimethoxysilane, based on 100 parts by weight of titanium oxide) was added. After stirring for 30 minutes, and neutralizing up to pH 6.5 by adding a sodium hydroxide solution of 4 mol/L, a filtration process, a washing process, and a drying process at 150° C. were conducted, followed by a pulverizing process with an air flow mill to obtain titanium oxide covering hydrophobic silica. This is designated as comparative external additive 1.

The number average primary particle diameter of comparative external additive 1 was 20 nm, and the BET value was 134.9 $m^2/g$. In this case, no crystallized titanium dioxide was confirmed via transmission electron microscopy observation.

<Comparative External Additive 2>

After calcinating external additive 1 at 1,450° C. for 10 hours, it was pulverized with an ejector, and was subjected to the same hexamethyldisilane treatment again.

The number average primary particle diameter of the resulting comparative external additive 2 was 120 nm, and it was confirmed via transmission electron microscopy observation that crystallized silica was fused on the surface of nucleus on which plural titanium dioxide crystals were sintered.

<Comparative External Additive 3>

A mixed solution containing octamethylcyclotetrasiloxane of 15 mol and tetraisopropoxy titanium of 6 mol was burned at 1,000° C. by subsidiary flame given via combustion of propane having oxygen of 96% by volume and water vapor of 4% by volume. The reaction temperature was set to 1,400° C. Cooling air was also introduced into the reaction pipe in such a way that high temperature retention time consumed in the reaction pipe was not more than 0.1 seconds, and the composite oxide composed of silica and titanium dioxide, manufactured by using a bag filter made of polytetrafluoroethelene was subsequently collected.

This composite oxide of 500 parts by weight was heated, was set in a high speed stirring mixer equipped with a cooling jacket, and while stirring at 500 rpm, pure water of 25 parts by weight was hermetically sprayed and supplied. Subsequently, this stirring was continuously conducted for 10 minutes. After this, hexamethyldisilazane of 25 parts by weight was added into what was produced, and the stirring was hermetically conducted for 60 minutes. Subsequently, a heat treatment process was also conducted while stirring, and produced ammonia gas and the residual treatment agent were eliminated while ventilating with nitrogen at 150° C.

The resulting composite oxide composed of silica and titanium dioxide is designated as comparative external additive 3. The number average primary particle diameter of the resulting comparative external additive 3 was 110 nm, and it was confirmed via transmission electron microscopy observation that no crystal was observed, but a homogeneous composite oxide composed of silica and titanium dioxide was observed.

<Comparative External Additive 4>

Comparative external additive 4 was prepared, similarly to comparative external additive 3, except that hexamethyldisiloxane of 85 parts by weight and aluminium tri-secbutoxide of 15 parts by weight were employed in place of the mixed solution containing octamethylcyclotetrasiloxane of 15 mol and tetraisopropoxy titanium of 6 mol in the preparation of comparative external additive 3 The number average primary particle diameter of the resulting comparative external additive 4 was 110 nm, and it was confirmed via transmission electron microscopy observation that no crystal was observed, but a homogeneous composite oxide composed of silica and aluminum oxide was observed.

The resulting external additive constitution, the number average primary particle diameter, the presence ratio of metal oxide on the surface determined by ESCA, and the BET value are shown in Table 1.

TABLE 1

| | External additive constitution | | Number average primary particle | Presence ratio of metal oxide on the surface determined by ESCA | BET |
|---|---|---|---|---|---|
| | Nucleus | Surface | diameter (nm) | (% by weight) | value ($m^2/g$) |
| External additive 1 | Amorphous silica | Titanium dioxide polycystal | 220 | 88.0 | 33.0 |

TABLE 1-continued

| | External additive constitution | | Number average primary particle | Presence ratio of metal oxide on the surface determined by ESCA | BET |
|---|---|---|---|---|---|
| | Nucleus | Surface | diameter (nm) | (% by weight) | value ($m^2/g$) |
| External additive 2 | Amorphous silica | Aluminum oxide polycystal | 220 | 76.0 | 31.0 |
| External additive 3 | Amorphous silica | Zirconium oxide polycystal | 220 | 68.0 | 30.0 |
| Comparative external additive 1 | Amorphous silica | Amorphous titanium dioxide | 20 | 94.2 | 134.9 |
| Comparative external additive 2 | Crystalline silica | Titanium dioxide polycystal | 120 | 95.8 | 135.2 |
| Comparative external additive 3 | Solid solution of amorphous silica and amorphous titanium dioxide | | 110 | 54.1 | 56.4 |
| Comparative external additive 4 | Solid solution of amorphous silica and amorphous aluminum oxide | | 110 | 52.4 | 55.8 |

<<Preparation of Toner Base Material>>

<Preparation of Toner Base Material 1>

(Preparation of Resin Particle (1 HML))

(1) Preparation of Core Particle (The First Step Polymerization):

In a flask, to which a stirrer, temperature sensor, cooler tube and nitrogen gas introducing device were attached, a surfactant solution-composed of 7.08 parts by weight of the following surfactant dissolved in 3010 parts by weight of deionized water was charged, and the temperature in the flask was raised up to 80° C. while stirring at a speed of 230 rpm under a nitrogen gas stream. Surfactant: $C_{10}H_{21}$ $(OCH_2CH_2)_2$ $OSO_3Na$ To the surfactant solution, an initiator solution composed of 9.2 parts by weight-of a polymerization initiator (potassium persulfate: KPS) dissolved in 200 parts by weight of deionized water was added and the temperature was adjusted to 75° C. After that, a monomer mixture liquid composed of 70.1 parts by weight of styrene, 19.9 parts by weight of n-butyl acrylate and 10.9 parts by weight of methacrylic acid is dropped to the solution spending for one hour. Then the system was heated and stirred for 2 hours at 75° C. to perform polymerization (the first step polymerization) for forming a dispersion composed of resin particles as the nucleus of a toner base material. This is designated as resin particle dispersion (1 H).

(2) Formation of Intermediate Layer (The Second Step Polymerization):

In a flask to which a stirrer is attached, 98.0 parts by weight of pentaerythritoltetrabehenate was added to a monomer mixture liquid composed of 105.6 parts by weight of styrene, 30.0 parts by weight of n-butyl acrylate, 6.2 parts by weight of methacrylic acid and 5.6 parts by weight of n-octyl-3-mercaptopropionic acid ester, and was dissolved by heating up to 90° C. to prepare a monomer solution.

On the other hand, a surfactant solution composed of 2,700 parts by weight of deionized water and 1.6 parts by weight of the foregoing anionic surfactant dissolved in the water was heated up to 98° C., and 28 parts by weight in terms of solid ingredient of the foregoing resin particle dispersion (1 H) was added to the surfactant solution. After that, the foregoing monomer solution of pentaerythritoltetrabehenate was mixed and dispersed for 8 hours by a mechanical dispersing apparatus (CLEARMIX) having a circulation pass manufactured by M-Technique Co., Ltd., to prepare a dispersion (emulsion) containing emulsified particles (oil droplets).

Then an initiator solution composed of 5.1 parts by weight of polymerization initiator (KPS) dissolved in 240 parts by weight of deionized water, and 750 parts by weight of deionized water were added to the dispersion (emulsified liquid), and the resulted system was heated and stirred for 12 hours at 98° C. for carrying out polymerization (the second step polymerization) to prepare a dispersion of composite resin particles each constituted by the high molecular weight resin particle covered with a intermediate molecular weight resin. This is designated as resin particle dispersion (1 HM).

Resin particle dispersion (1 HM) was dried and observed by a scanning electron microscope. A particle (400-1000 nm in size) principally composed of pentaerythritoltetrabehenate which was not surrounded by the resin particles was observed.

(3) Formation of Outer Layer (The Third Step Polymerization):

To thus obtained resin particle dispersion (1 HM), an initiator solution composed of 7.4 parts by weight of the polymerization initiator (KPS) dissolved in 200 ml of deionized water was added and a monomer mixture liquid composed of 300 parts by weight of styrene, 95 parts by weight of n-butyl acrylate, 15.3 parts by weight of methacrylic acid and 10.4 parts by weight of n-octyl-3-mercaptopropionic acid ester was dropped spending for one hour. After completion of the dropping, the resulted system was heated and stirred for 2 hours for carrying out the polymerization (the third step of polymerization) and then cooled down to 28° C. Thus a dispersion of resin particles (composite resin particles having a core composed of the high molecular weight resin, the intermediate layer composed of the intermediate molecular weight resin and an outer layer composed of a low molecular weight resin, and also containing pentaerythritoltetrabehenate in an intermediate layer) was obtained. This dispersion is designated as resin particle dispersion (1 HML).

The composite resin particle constituting resin particle dispersion (1 HML) had peaks of molecular weight at 138,000, 80,000 and 13,000. The weight average particle diameter of this resin particle was 122 nm.

In 1,600 parts by weight of deionized water, 59.0 parts by weight of the foregoing anionic surfactant was dissolved. To the solution, 420.0 parts by weight of carbon black Regal 330, manufactured by Cabot Co., Ltd., was gradually added and dispersed by CLEAMIX manufactured by M-Technique Co., Ltd., for preparing a dispersion of the colorant particle (hereinafter also referred to as Colorant Dispersion 1). As a result of the measurement of the particle diameter of the colorant particle by electrophoretic light scattering photometer ELS-800 manufactured by Ootsuka Denshi Co., Ltd., the weight average particle diameter was 89 nm.

Into a reaction vessel (four-mouth flask) equipped with a thermal sensor, a cooler, a nitrogen introducing device and a stirrer, 420.7 parts by weight of resin particle dispersion (1 HML) (in terms of solid ingredient), 900 parts by weight of deionized water and 166 parts by weight of colorant dispersion 1 were charged and stirred. After adjusting the temperature of the vessel to 30° C., pH value of the liquid was set to 10.0 by adding sodium hydrate of 5 mol/L into this solution.

And then a solution composed of 12.1 parts by weight of magnesium chloride hexahydrate dissolved in 1,000 parts by weight of deionized water was added spending for 10 minutes while stirring at 30° C. After standing for 3 minutes, the liquid was heated up to 90° C. spending a period of time from 6 to 60 minutes for forming associated particles. The diameter of the associated particle was measured in such the situation by Coulter Counter TA-II manufactured by Coulter Corporation, and a solution composed of 80.4 parts by weight of sodium chloride dissolved in 1,000 ml of deionized water was added at the time when the number average diameter is attained at 4 μm to stop the growing of the particles. The liquid was further heated and stirred for ripening at 98° C. for 2 hours so as to continue the phase separation.

Thereafter, the system was cooled down to 30° C. and the pH is adjusted to 4.0, and then the stirring was stopped. The resulted associated particles were separated by a basket type centrifugal separator Mark III type No. 60×40. manufactured by Matsumoto Kikai Mfg. Co. Ltd. for forming a cake of the toner base material. The cake of the toner base material was washed in the basket type centrifugal separator, then moved to Flash Jet Dryer and dried until the moisture content was reduced by 0.5% by weight, to prepare toner base material 1. In addition, median particle diameter ($D_{50}$) of this toner base material was 7.0 μm.

<Preparation of Toner Base Material 2>

After premixing 100 parts by weight of styrene-acrylic resin having two peak molecular weight distributions as a binder resin, 4 parts by weight of low molecular weight polypropylene as a parting agent, and 4 parts by weight of carbon black, they were melted and mixed with a twin screw extruder, and what was obtained after a cooling-solidification process was pulverized and then classified to prepare toner base material 2. In addition, median particle diameter ($D_{50}$) of this toner base material was 7.1 μm.

<<Preparation of Toner>>

1.0 parts by weight of the foregoing external additive described in Table 1 was added into 100 parts by weight of the above toner base material as described in Table 2, and a mixing process was conducted with a HENSCHEL mixer manufactured by Mitsui Miike Co., Ltd. Subsequently, coarse particles were removed using a sieve of 45 μm opening to prepare toners 1-6 and comparative toners 1-4.

TABLE 2

| Toner No. | External additive No. | Toner base material No. | Toner binder resin |
|---|---|---|---|
| Toner 1 | External additive 1 | Toner base material 1 | Ionic dissociative group contained |
| Toner 2 | External additive 2 | Toner base material 1 | Ionic dissociative group contained |
| Toner 3 | External additive 3 | Toner base material 1 | Ionic dissociative group contained |
| Toner 4 | External additive 1 | Toner base material 2 | No ionic dissociative group contained |
| Toner 5 | External additive 2 | Toner base material 2 | No ionic dissociative group contained |
| Toner 6 | External additive 3 | Toner base material 2 | No ionic dissociative group contained |
| Comparative toner 1 | Comparative external additive 1 | Toner base material 1 | Ionic dissociative group contained |
| Comparative toner 2 | Comparative external additive 2 | Toner base material 1 | Ionic dissociative group contained |
| Comparative toner 3 | Comparative external additive 3 | Toner base material 1 | Ionic dissociative group contained |
| Comparative toner 4 | Comparative external additive 4 | Toner base material 1 | Ionic dissociative group contained |

<<Image Forming Apparatus for Evaluation>>

A remodeled apparatus, in which 10 mmϕ development rollers were installed with a printer PagePro1350W equipped with a developing apparatus for a non-magnetic single component developer manufactured by Konica Minolta Business Technologies, Inc. (20 copies/min. in printing speed), was employed as am image forming apparatus for evaluation.

<<Practical Picture Evaluation>>

The remodeled apparatus used for the above printer PagePro1350W was loaded with the above toners 1-6 and comparative toners 1-4 by turns, and the following properties were evaluated. Incidentally, A and B indicate "pass" with no problem, and C and D indicate "fail" with a problem.

<Charge Rising and Charging Stability>

A toner of 50 g was set to a small developing apparatus installing small developing rollers having a diameter of 10 mmϕ to stoke a toner of 10 g in a supplier. After this, the small developing apparatus was stirred alone, and time that elapses before a maximal charging amount is obtained was measured. A charging amount equivalent to the lowered value was measured after keeping on stirring for 120 minutes from the start of stirring with no toner replacement. The charging amount was measured employing a blow-off charging amount measuring method.

A: Elapsed time before a maximal charging amount is acquired is less than 1.5 seconds, and a charging amount equivalent to the lowered value after 120 minutes is less than 5 μC/g; (Excellent).

B: Elapsed time before a maximal charging amount is acquired is not less than 1.5 seconds and less than 3.5 seconds, and a charging amount equivalent to the lowered value after 120 minutes is not less than 5 μC/g and less than 10 μC/g; (Good).

C: Elapsed time before a maximal charging amount is acquired is not less than 3.5 seconds and less than 5.0 seconds, and a charging amount equivalent to the lowered value after 120 minutes is not less than 10 μC/g and less than 15 μC/g; (Slightly poor).

D: Elapsed time before a maximal charging amount is acquired is not less than 5.0 seconds, and a charging amount equivalent to the lowered value after 120 minutes is not less than 15 μC/g; (Poor).

<Fog in the High Consumption Mode>

An image pattern having an imaging area of 85% was selected, and 200 paper sheets were continuously printed in the frequent toner replacement mode, to measure and evaluate the density at non-image portion of two hundredth paper sheet as fog.

The absolute density of not printed paper (white paper) was measured at 20 points and the average of the measured values was defined as the white paper density. Then the absolute density of the white image portion of the printed image was measured at 20 points and the average value was calculated. The value obtained by subtracting the white paper density from the average density was evaluated as the fog density. The measurement was carried out by Macbeth Reflective Densitometer RD-918, manufactured by Macbeth Co., Ltd.

Evaluation Criterion

A: Fog density is not more than 0.005; (Good).

B: Fog density is not more than 0.01; (with no problem produced in practical application).

D: Fog density exceeds 0.01; (with a problem produced in practical application).

<Variations in Tonal Resolution>

After the foregoing image evaluating apparatus was left standing for 120 hours at high-temperature and humidity such as 30° C. and 80% RH, an original image having 60 tonal resolution levels of from a white image to a solid black image was printed to evaluate variations in tonal resolution at the initial stage and at the stage after standing for a long period of time. Images of tonal resolution levels were visually observed under sufficient daylight conditions to evaluate the total number of levels in significant tonal resolution levels.

Evaluation Criterion

A: Tonal resolution is not less than 41 tonal resolution levels for both prints at the initial stage and at the stage after standing for a long period of time; (Good).

B: Tonal resolution is not less than 21 and not more than 40 tonal resolution levels for both prints at the initial stage and at the stage after standing for a long period of time; (with no problem produced in practical application).

C: Tonal resolution is not less than 11 and not more than 20 tonal resolution levels for a print at the stage after standing for a long period of time; (with a problem produced in the case of image quality in which emphasis is placed on tonal resolution.

D: Tonal resolution is not more than 10 tonal resolution levels for a print at the stage after standing for a long period of time; (with a problem produced in practical application).

Practical picture evaluation results are shown in Table 3.

TABLE 3

| | Toner No. | Charge rising and Charging stability | Fog in the high consumption mode | Variations in tonal resolution |
|---|---|---|---|---|
| Example 1 | Toner 1 | A | A | A |
| Example 2 | Toner 2 | A | A | A |
| Example 3 | Toner 3 | A | A | A |
| Example 4 | Toner 4 | B | B | B |
| Example 5 | Toner 5 | B | B | B |
| Example 6 | Toner 6 | B | B | B |
| Comparative example 1 | Comparative toner 1 | D | D | D |
| Comparative example 2 | Comparative toner 2 | D | D | D |
| Comparative example 3 | Comparative toner 3 | D | D | D |
| Comparative example 4 | Comparative toner 4 | D | D | D |

It is to be understood that Examples 1-6 are excellent in any of the evaluation items, but Comparative examples 1-4 produce problems in some of the evaluation items.

As is also clear from Example above, a toner containing external additives in which amorphous silica is placed as a nucleus, and a crystallized metal oxide selected from titanium oxide, aluminum oxide, zirconium oxide, or calcium oxide is present on the nucleus surface, can obtain speedy charge rising capability and enables to prepare high-speed printing.

The above external additives applied to a toner of a small particle diameter make it possible to provide an electrostatic charge image developing toner capable of generating an excellent charge rising capability with no occurrence of "packing", even though the apparatus is idle for a long period of time. As a result, stable image formation with no occurrence of toner "packing" can be provided for users who do not operate printers for a comparatively long period of time at home or in small offices. Since fluidity is sufficiently provided in a toner, a given amount of toner can also be transported during printing, so that variation in tonal resolution for the prints, caused by toner transport problems or insufficient supply of toner, are not generated. As a result, prints containing graphs and photographic images, whose contents are easily identified, can be obtained to produce printers satisfying the demand at home or in small offices. A toner of a small particle diameter also makes it possible to form a stable toner image exhibiting high-resolution.

The toner of the present invention is specifically capable of providing a simple and compact printer with no increase in the number of parts as well as with no complicated structure.

What is claimed is:

1. An electrostatic charge image developing toner comprising a toner base material, and external additives comprising at least amorphous silica and a crystallized metal oxide selected from titanium oxide, aluminum oxide, zirconium oxide, or calcium oxide, wherein the amorphous silica is placed as a nucleus, and the crystallized metal oxide in the form of a layer covers an entire surface of the nucleus, and an amount of the external additives added to the toner base material is 0.1-2% by weight, based on the toner base material, where the toner base material is a toner material before the external additives are added, wherein the crystallized metal oxide is adhesively fused around the entire surface of the nucleus.

2. The electrostatic charge image developing toner of claim 1, wherein the metal oxide includes a titanium oxide.

3. The electrostatic charge image developing toner of claim 1, wherein the metal oxide includes an aluminum oxide.

4. The electrostatic charge image developing toner of claim 1, wherein the metal oxide includes a zirconium oxide.

5. The electrostatic charge image developing toner of claim 1, wherein the amorphous silica surface is covered by the metal oxide.

6. The electrostatic charge image developing toner of claim 1, comprising a binder resin derived from copolymerizing acrylic acid or methacrylic acid of 1-10% by weight of the binder.

7. The electrostatic charge image developing toner of claim 6, wherein the binder resin is a styrene-acryl copolymer or a polyester resin.

* * * * *